US006059237A

United States Patent [19]

Choi

[11] Patent Number: 6,059,237

[45] Date of Patent: May 9, 2000

[54] INTERACTIVE TOY TRAIN

[75] Inventor: Kei Fung Choi, Hong Kong, The Hong Kong Special Administrative Region of the People's Republic of China

[73] Assignee: Silverlit Toys Manufactory, Ltd., Causeway Bay, The Hong Kong Special Administrative Region of the People's Republic of China

[21] Appl. No.: 09/069,007

[22] Filed: Apr. 28, 1998

[51] Int. Cl.[7] ..... B61L 3/00

[52] U.S. Cl. ..... 246/192 A; 246/196; 246/195; 246/193; 246/201; 246/207; 104/296; 104/295

[58] Field of Search ..... 246/192 R, 193, 246/195, 196, 200 R, 192 A, 201, 202, 206, 207; 104/288, 295, 296, 304, 305, 302, 303

[56] References Cited

U.S. PATENT DOCUMENTS

| | | | |
|---|---|---|---|
| 1,306,732 | 3/1919 | Anderson | 246/206 |
| 1,318,566 | 10/1919 | Julian | 246/180 |
| 1,349,708 | 8/1920 | Beckwith | 246/207 |
| 1,561,411 | 11/1925 | Culver | 104/296 |
| 1,589,096 | 6/1926 | Becker | 104/296 |
| 3,664,060 | 5/1972 | Longnecker . | |
| 4,266,368 | 5/1981 | Nyman . | |
| 5,174,216 | 12/1992 | Miller et al. . | |
| 5,454,513 | 10/1995 | Wilson . | |
| 5,555,815 | 9/1996 | Young et al. . | |
| 5,816,886 | 10/1998 | Cusolito | 446/444 |
| 5,816,887 | 10/1998 | Rudell et al. | 446/456 |

*Primary Examiner*—Mark T. Le
*Attorney, Agent, or Firm*—Oppenheimer, Wolff & Donnelly LLP

[57] ABSTRACT

A toy train system has movable and removable trigger devices to be located by a user wherever selected on the toy train track. The train locomotive includes the ability to activate a sound and a light signal which can correspond to the sound. The train locomotive is capable of manipulating and changing the speed of the train over the track. The track can have an ascending and descending tracks and curves, and the tracks have ridges for engaging the locomotive, and can be set up by a user as required.

22 Claims, 10 Drawing Sheets

INTERACTIVE TOY TRAIN

BACKGROUND OF THE INVENTION

This invention relates to a toy train. In particular, it relates to an interactive toy train which has the ability to produce sound and to have different movements on a track.

Many toy trains are known. For instance, a toy train is described and illustrated in U.S. Pat. No. 5,174,216. This train discloses the ability to generate different sounds. Also, the speed of the train can be controlled. The toy train, however, is limited in its variety of features. U.S. Pat. No. 5,555,815 relates to a train which has the ability to control sound. There is a controller which reacts to the speed of the train. U.S. Pat. No. 5,454,513 is concerned with developing a clacking sound by mechanical interaction from the rails.

There are many different features associated with toy trains. The present invention, however, is concerned with providing a toy train which possesses advantages over those of the prior art.

SUMMARY OF THE INVENTION

By this invention there is provided a toy, preferably train, which has multiple movable and removable trigger devices to be located by a user wherever selected on the toy train track. The locomotive for the train has a switch operable by the trigger device, and the locomotive includes a programmed chip which includes the ability to activate a sound and, selectively, a light signal which can correspond to the sound. The same programmed chip is capable of manipulating the speed of the train over the track. The switch is a reactive device and includes a leaf spring in the locomotive which activates and deactivates the control system in the chip.

The track can have ascending and descending tracks and curves, and can be set up by a user as required. The track defines a closed circuit, and includes component lengths which are separable and connectable to form a user-selected close circuit. There are multiple trigger devices which are separable from the track, and the devices have connector means for permitting the trigger devices to be secured in selected location with the track.

Where the toy is a train, there is a locomotive for traveling on a track, the locomotive having motor means for turning wheels of the locomotive on the track, and including a power supply for the motor means. The electronically programmed chip within the locomotive responds to signals from the switch to control the wheel rotation. The wheels include teeth about there periphery which engage teeth on the tracks so that the wheels can engage the track through their passage on the track.

Each trigger device include multiple activating members. There are at least two switches in the locomotive, and the passage of the locomotive over a trigger device effects activation of at least one of the multiple switches at least once. Each trigger device can activate a switch multiple times during the passage of the locomotive over the trigger device. Each trigger device can have indicia associated with the trigger such that the particular action to be imparted by each trigger on the locomotive can be seen by a user.

The invention is further described with reference to the accompanying drawings.

DETAILED DESCRIPTION OF THE PREFERRED EMBODIMENT

Figure 1:
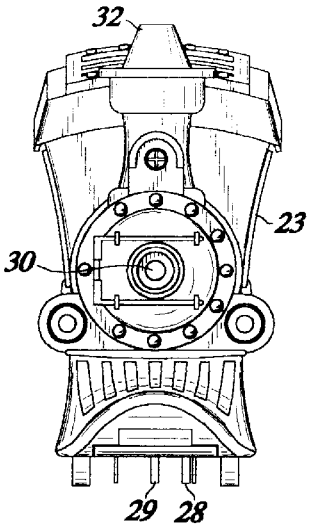
FIG. 1 is a front view of the locomotive, showing two transversely spaced leaf springs of the switch.
Figure 2:
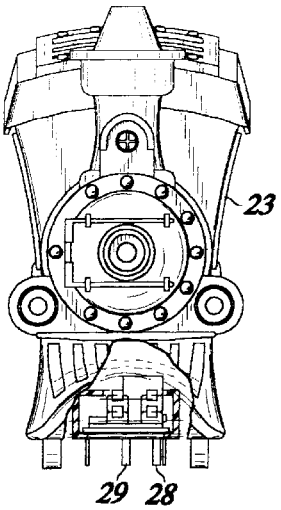
FIG. 2 is a front view of the locomotive with parts broken away, showing the leaf springs of the switch.
Figure 3:
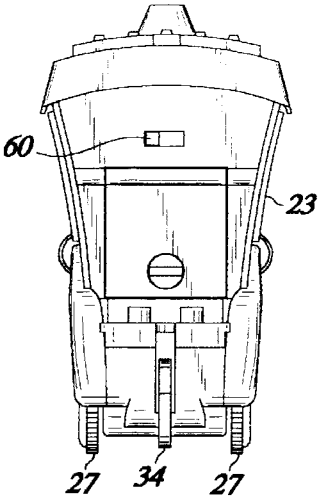
FIG. 3 is a rear view of the locomotive.
Figure 4:
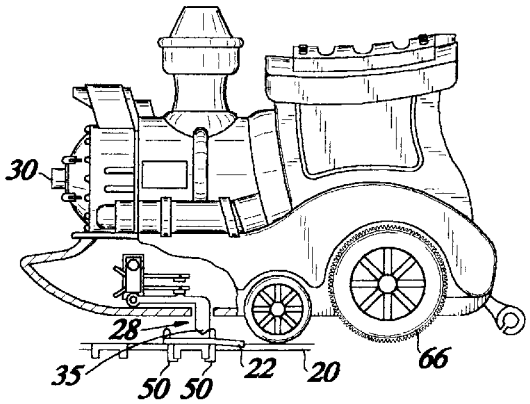
FIG. 4 is side view of the locomotive with parts broken away in a first operational state, and showing one leaf spring contact between the spaced elements of the sensor trigger.
Figure 5:
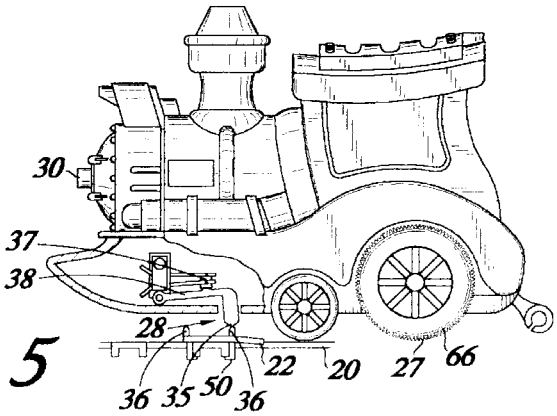
FIG. 5 is a side view of the locomotive with parts broken away in a second operational state, and showing the contact of the leaf spring contacting one element of the sensor trigger.
Figure 6:
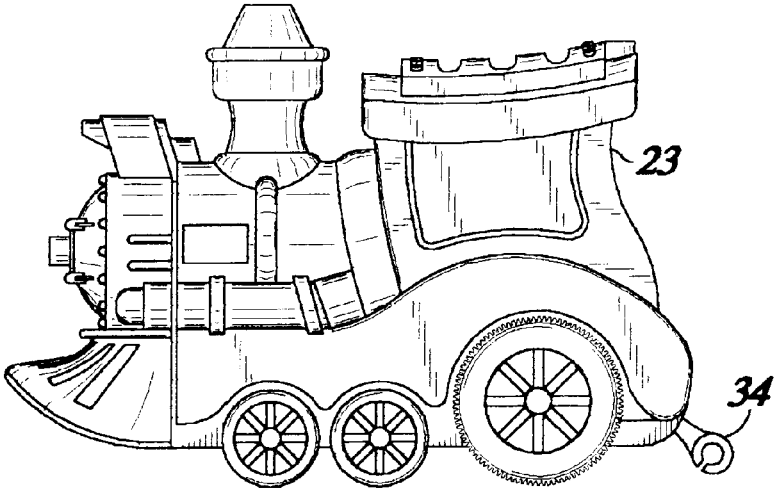
FIG. 6 is a side view of the locomotive.
Figure 7:
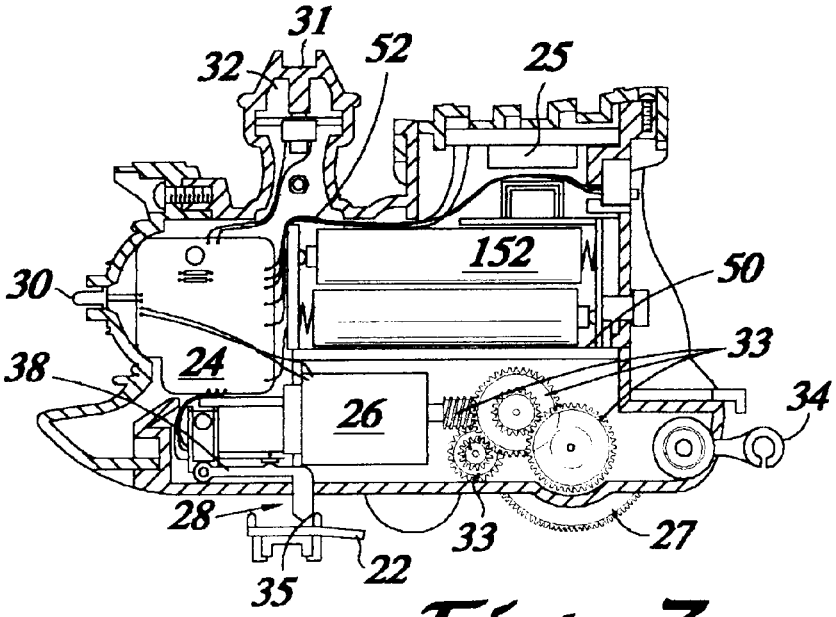
FIG. 7 is a sectional side view of the locomotive showing the side view of the sensor trigger and the contact between the elements, and also showing the batteries, motor, gears and circuit board with the chip.

A toy train comprises a locomotive 23 for a toy train. The locomotive includes wheels 27, a motor 26 to rotate the wheels 27, and a control system for regulating the wheel rotation. There is a track on which the locomotive 23 is operable whereby the wheels 27 move over the track, and there is at least one switch 28 in the locomotive 27. A trigger device or sensor 22 is located with the track 20 and 21 for operating the switch 28, and the operation of the switch 28 activates the control system and thereby operates the motor 26 in the locomotive.

There are preferably at least two switches 28 and 29 in the locomotive 23, the switches being located in transverse relationship relative to the longitudinal direction between the forward and rearward positions of the locomotive 23. The switches 28 and 29 can be operable by each sensor 22 at least twice as the locomotive 23 moves over the sensor 22.

Figure 12:
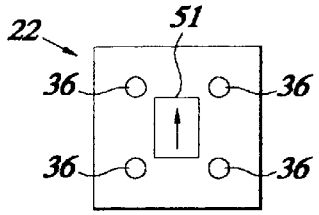
FIG. 12 is a plan view of the sensor triggers which are located on the track position, and showing four spaced trigger elements for activating the two leaf springs.

As illustrated in FIG. 12 the sensor 22 can include at least four spaced trigger elements 36, and the sensor 22 includes connector means 50 for permitting moveability and removeability from the track 20 and 21 as selected by a user. At least two triggers 36 are aligned longitudinally relative to each other such that each switch 28 in the locomotive 23 can be operated twice as the locomotive 23 moves longitudinally over the track. A second pair of triggers 36 is longitudinally arranged in adjacent relationship such that a second switch 29 in the locomotive 23 is operated at least twice as the locomotive moves over the track 20.

In different forms, there can be different numbers of triggers 36 on each sensor 22. Thus, there can be a single, two or three triggers on respective sensors 22. By arranging the triggers 36 differently, there are different presentations and combinations of signalling that can be provided to the switches 28 and 29. This can then signal the control system to react according to the signals received. Indicia 51 can be provided on each sensor 22 to indicate how that sensor will react with the locomotive 23. This is described further below. Instead of four triggers and two switches, variations of the train could include a greater number, and hence more variables.

The control system operates selectively with the wheels 27 to permit forward or rearward movement, the speed with which the wheels 27 move forward or rearwardly, and the overall regularity of motion of the locomotive 23 being relatively smooth or being irregular. The control system further operates a light source 30 and a speaker such that activation of a switch 28 and/or 29 can selectively operate a light 30 and a speaker, and selectively additionally the coordinated rotation of the wheels 27 of the locomotive 23.

There is a battery compartment 52 in the locomotive 23, and the motor 26 is battery operable. The motor 26 is capable of adapting the speed of the wheels 27 according to signals received from the control system.

The locomotive 23 is operable over the track in a first operational condition when the track is devoid of any sensors 22 on the track 20, and the locomotive 23 is operable over the track in a second operable condition when at least one or more sensors 22 is located on the track 20.

Figure 9A:
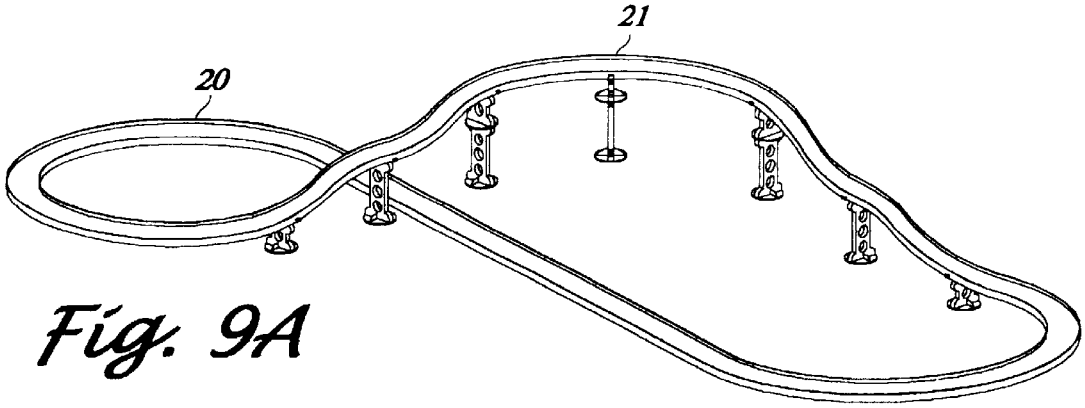
FIG. 9A is a perspective view showing one assembly of the track having curves and an ascending and descending configuration.
Figure 9B:
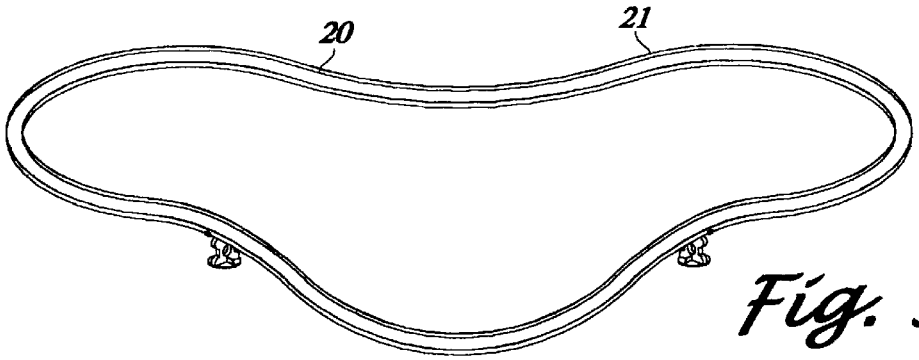
FIG. 9B is a second perspective view of a track in a different formation showing different curves and different ascending and descending formations.
Figure 9C:
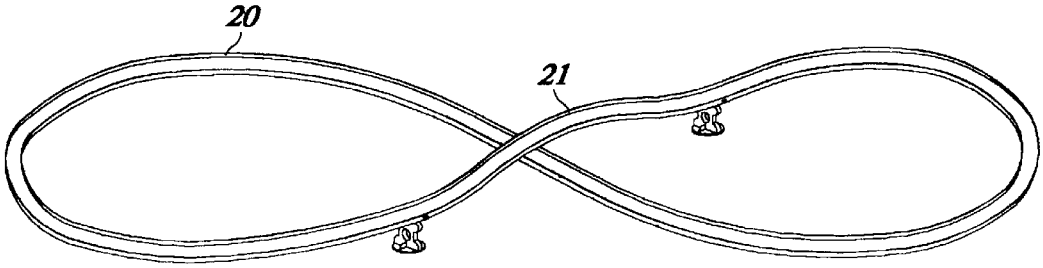
FIG. 9C is a third perspective view of a track showing a different configuration and having different ascending and descending configurations.
Figure 9D:
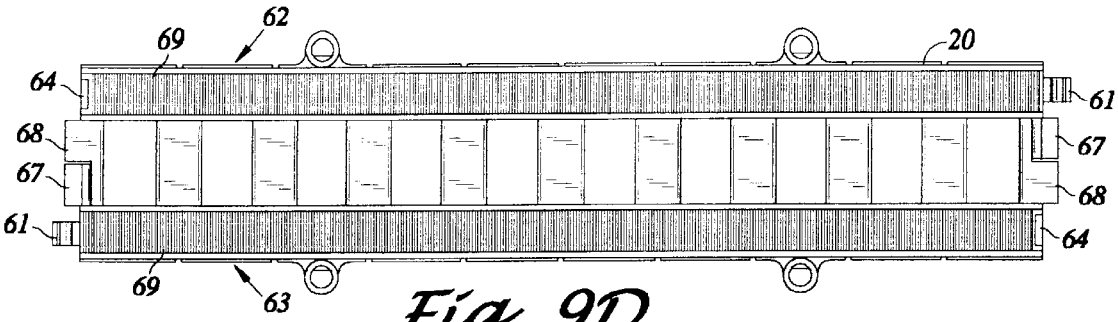
FIG. 9D is a plan view section of a track which is for assembly with other track portions.
Figure 9E:
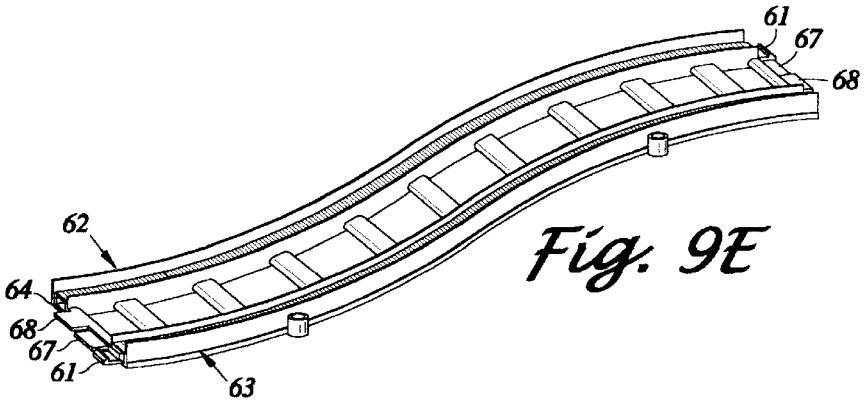
FIG. 9E is a perspective view of a different section of the track having an ascending and descending portion within the track.
Figure 9F:
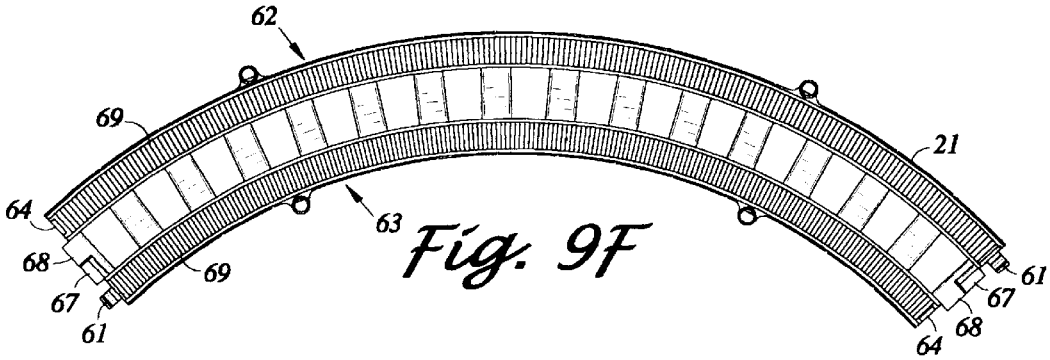
FIG. 9F is a plan view of a curved portion of a track.
Figure 10A:
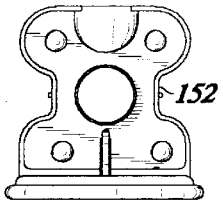
FIGS. 10A–10J are different views of column configurations and supports for a track whereby a track can be assembled and supported in a manner to have different ascending and descending heights.
Figure 10B:
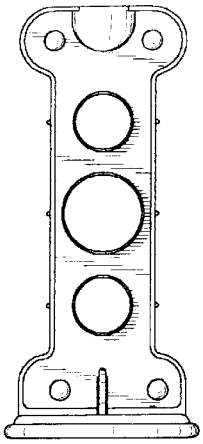
Figure 10C:
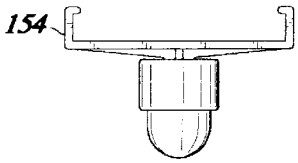
Figure 10D:
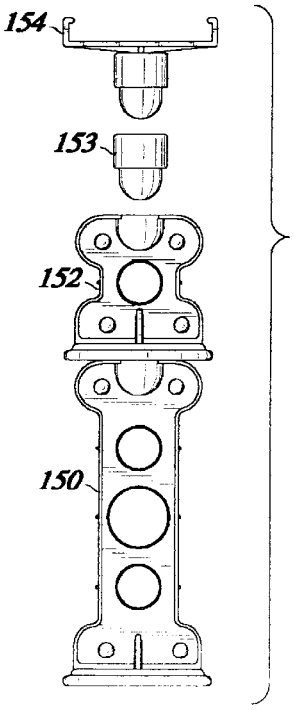
Figure 10E:
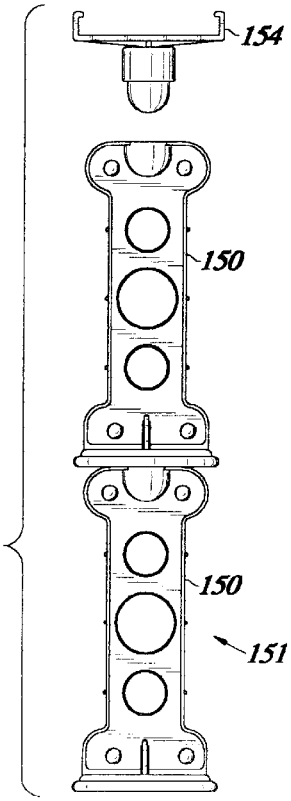
Figure 10F:
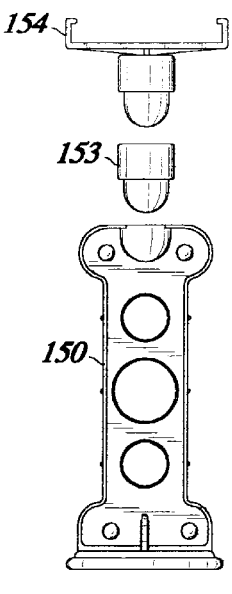
Figure 10G:
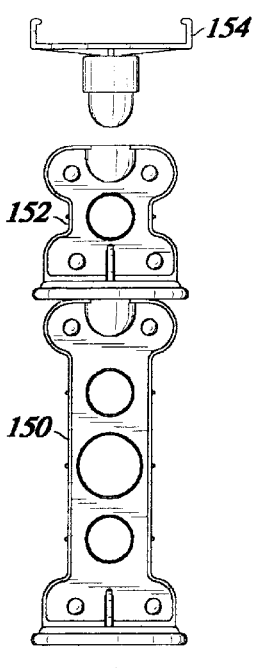
Figure 10H:
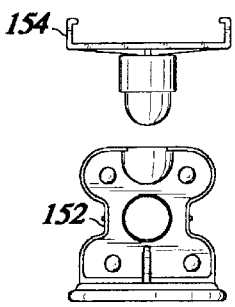
Figure 10I:
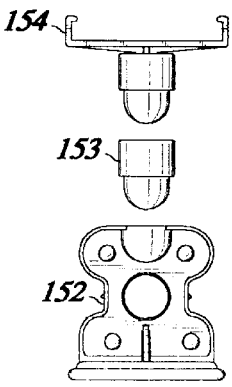
Figure 10J:
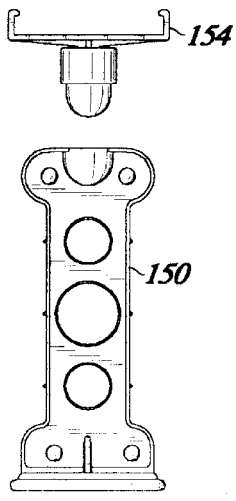

The interactive toy railway system is assembled from component rail track parts 20 and 21 to form a continuous track as illustrated in FIGS. 9A to 9C. Along the track, a child can selectively place different sensors 22 with trigger 22. The sensors 22 are activated when the train, particularly the locomotive 23 runs over the triggers 36 on the track 20 and 21. When the triggers 36 activate a reactive element, namely, the switches 28 and/or 29, the locomotive 23 can give off different noises according to what is programmed in the chip in the locomotive 23.

For instance, the chip in the circuit board 24 in the train can generate the sound of a farmyard in a place near the railway track 20 and 21, where there is located a farmyard. An appropriate interactive sensor 22 is located in one or more of the rail tracks 20 and 21 near the farmyard. When the train runs over the sensor 22, the triggers 36 activate the locomotive speaker 25 and farm sounds from the locomotive 23 emanate from a speaker 25.

In another case, for example, an appropriate sensor 22 can be located in or near a bridge. The chip in the locomotive 23 can generate the sound of a creaking bridge, which is activated when the locomotive 23 or train approaches or passes over the bridge.

In other forms, the chip on the board 24 can also act to operate one or more motors 26 for turning the locomotive wheels 27 to cause the train to speed up, go in reverse, stop for a period of time, or move irregularly.

The reactive elements or switches 28 and 29 in the locomotive 23 or train are such as to react to the signals which are triggered from the triggers 36 in the sensor placed 22 on the track. Each of the switches 28 and 29 include a contact 35 for engaging triggers 36 which respectively are placed on the respective sensors 22. Each switch 28 and 29 includes a respective leaf spring 37 which is operated by the arm 38 leading from the contact 35. Sensors 22 can be adjusted and placed in different locations on the track 20 and 21, and the locomotive 23 can go up and down hills formed by the tracks in a normal course. The sensor 22, through the programmed chip in the board 24, can also activate the light source 30 in the locomotive 23 or train such that light effects are selectively triggered and given off by the locomotive 23 which is pulling the train.

In order for the sensors 22 to work properly they are placed in the correct position and direction to ensure the desired outcome. The user should keep a certain distance between respective sensors 22 on the tracks 20 and 21. Two sections of track 20 and 21 between respective sensors 22 is recommended.

This system enhances the play-value of a train set. The creative game or toy train is provided with two set levels. Each level contains different actions, sound effects and lighting. Children can take a journey and enjoy the fun of at least 12 different scenarios. A scenario is an imagined scene with a sequence of preset actions accompanied by sound effects and lighting.

This toy and game permits children to create their own track 20 and 21 layout and place the sensors 22 in the correct positions in order to view the varying actions, specific sound effects, and lighting. In addition to the fun the children can enjoy, they can also develop their imagination, judgment, evaluation, and organizational skills through this game.

Components and Functions

The leaf switch configuration of the switches 28 and 29 are located at the bottom of the locomotive 23. The switch configuration which includes at least two separate switches 28 and 29 which interface with the triggers 36 of the sensors 22 in the rail track 20 and 21.

A "Stop/Start" switch 31 in the locomotive 23 is pressed, in addition to turning the power switch 60 to the "ON" position, in order for the train to start. The "Stop/Start" switch 60 is installed in the chimney 22 of the locomotive 23.

An LED 30 is a water-clear, Ø3.0 mm, super bright, red light, and is synchronized with action and sound by a software program in the chip on the circuit board 24 which is located in the locomotive 23.

A speaker 25 is 8 ohm, 0.25 w, Ø29.0 mm. The sound signal is preset and relates to the different scenarios.

A software program, which is part of a custom chip on the board 24, controls the motor 26 to cause the wheels 27 of the locomotive 23 to rotate forwards or backwards or stay stationary. A gearing system 33 is used for transmitting the motion between the motor shaft and the wheels 22.

A power supply of 4.5 v, 3 AAA size batteries 152 for both the motor 26 and control unit of the board 24 are needed. The power consumption is low. Even when the power switch 60 is turned on, the power can last for a year if the "Start/Stop" key has not yet been pressed.

Operation Description

The first steps of the basic or first level of track 20 and 21 operation are that of setting up the track layout and placing the accessories. Specially designated inter-locks 61, 62, 63 and 64 on the ends of the tack portions 20 and 21 ensures the track portions join together easily and firmly. These inter-locks 61, 62 and 63 extend from the ends of the tracks 20 and 21 to effect the engagement. Interlock 64 is an insert slot for receiving the tongue portion 61. The tracks 20 and 21 can be different heights in different places by inserting columns 150 under certain sections of the track 20 and 21. The height of the track 20 and 21 depends on the height of the column used. The outcome of the track shape and design depends on the creativity of the child playing and constructing the track. Different column heights 151 and 152 are provided. There are mountings 153 provided for the columns under the tracks 20 and 21. A cradle 154 can be located between the mountings 153 and the track 20 and 21. The track includes two paths 62 and 63 which each have a series of spaced grooves or teeth 65 for gripping the grooves or teeth 66 around the periphery of the wheels 27. This ensures that the locomotive 23 can move over the tracks 20 and 21, and particularly, be stable in moving up and down or irregularly on the track 20 and 21.

Next, the locomotive 23 and cartage are placed on the track 20 and 21. The locomotive 23 and carriages are connected through a hook 34 at the rear of the locomotive 23. The power switch 60 is turned to the "ON" position, and then the "Start/Stop" key 31 is pressed. The train can now start its journey. The train keeps running until the "Start/Stop" key is pressed again, or the power switch 60 is turned to the "OFF" position.

The same locomotion has two play levels: Junior Level and Advanced Level.

Junior Level—If the train runs for more than one minute without the leaf switch 28 or 29 receiving a sensor signal, it performs preset sequential actions and sound effects. Table 1 sets out the details. The train keeps running until the "Start/Stop" key 31 is pressed again, or the power switch is turned to the "OFF" position. If either of the leaf switches 28 or 29 receives the sensor signal, the train switches to the Advanced Level.

Advanced Level—When the child becomes familiar with the sounds and actions, they can reproduce the desired scenario by inserting the sensors in the appropriate places. When the train runs over the sensor and a selected leaf switch receives the specific signal, it performs the preset sound effects and actions of that signal.

In one form of the invention or assembly there are 12 sensors which represent 12 different scenarios. Table 2 sets out the details. If one or other of the leaf switches 28 and 29 does not receive a sensor signal within a minute of the train running, it switches back to the Junior Level.

Figure 8:
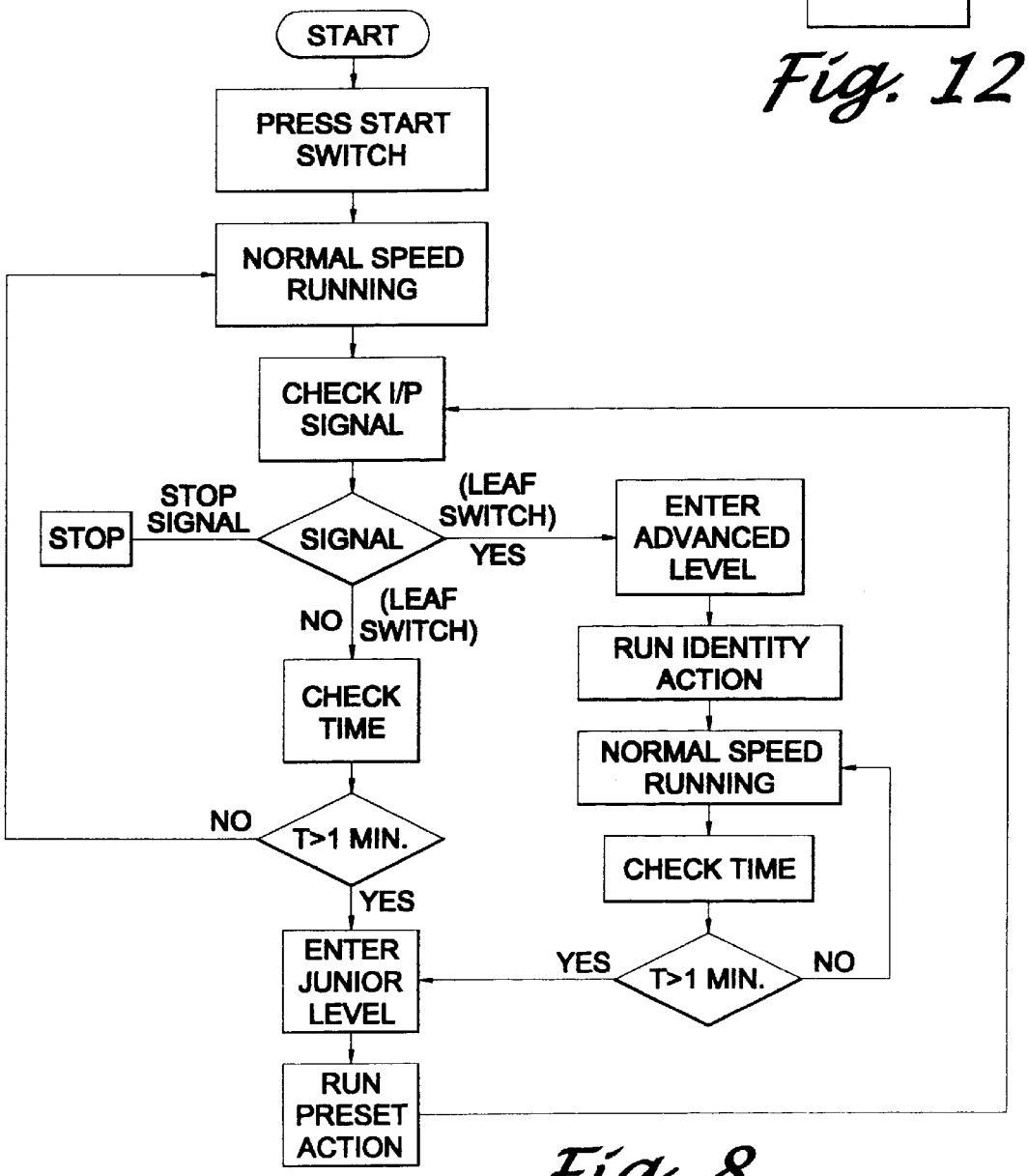
FIG. 8 is a flow diagram of the operation of the locomotive.

The placing of the sensor 22 leads the train into the Advanced Level, not another locomotion. The flow chart in FIG. 8 sets out the details of the operation. As can be seen in FIG. 8, the operation begins by pressing the start switch. Immediately the train goes to normal running speed. After checking the input signal, a determination is made of which leaf spring (28 or 29) is operated. With the one switch operated, the train enters an advance level and operates at a normal speed running for a period of time. If less than a minute expires, it will re-enter the junior level and run according to the preset action. If the leaf spring (28 or 29) is not operated, the train will enter the normal running speed.

TABLE 1

Junior Level Program

| Step | Action | Duration (seconds) |
|---|---|---|
| 1 | Normal Running | 60 |
| 2 | Woo-Woo-Woo (Sound of train locomotive) | / |
| 3 | Normal Running | 5 |
| 4 | Stop | / |
| 5 | Normal Running | 4 |
| 6 | High Speed Traveling | / |
| 7 | Normal Running | 3 |
| 8 | Melody - "Oh! Susanna" | / |
| 9 | Normal Running | 5 |
| 10 | Stop | / |
| 11 | Normal Running | 5 |
| 12 | Ding-Ding-ding (Sound of the bell) | / |
| 13 | Woo-woo-Woo (Sound of the horn) | / |
| 14 | Stop | / |
| 15 | Normal Running | 6 |
| 16 | Woo-Woo-Woo (Sound of the horn) | / |
| 17 | High Speed Traveling | / |
| 18 | Stop | / |
| 19 | Ding-Ding-Ding (Sound of the bell) | / |
| 20 | Normal Running | 5 |
| 21 | Stop | / |
| 22 | Normal Running | 10 |
| 23 | Woo-Woo-Woo (Sound of the horn) | / |
| 24 | Ding-Ding-Ding(Sound of the bell) | / |
| 25 | Stop | 3 |

Remarks: Steps 2–25 run repeatedly.

TABLE 2

Advanced Level Program

| Item | Leaf Switches A and B each operable twice by each sensor A | B | Scenario | Sound Effect Duration (Seconds) |
|---|---|---|---|---|
| 1 | ○ | ● | Train stops at stations. Crowds of people getting on and off. Then train starts again. | 13.824 |
| | ○ | ○ | | |
| 2 | ○ | ● | Train stops. Press "Start/Stop" key to restart. | 3.112 |
| | ○ | ● | | |
| 3 | ● | ○ | Train runs over the dinosaur's back, passenger screams. | 9.611 |
| | ○ | ○ | | |
| 4 | ● | ● | High speed traveling. | 4.043 |
| | ○ | ○ | | |
| 5 | ● | ○ | Train runs across road junction. | 5.421 |
| | ○ | ● | | |
| 6 | ● | ● | Train stops to let cows cross the rail and starts again. | 17.301 |
| | ○ | ● | | |
| 7 | ○ | ● | Train play the melody "Oh! Susanna". | |
| | ● | ○ | | |
| 8 | ○ | ● | Train runs under the thunderstorm. | 11.773 |
| | ● | ● | | |
| 9 | ● | ○ | Train crosses the old wooden bridge. | 10.570 |
| | ● | ○ | | |
| 10 | ● | ● | Train is sucked into the whale's mouth but finally escapes. | 11.626 |
| | ● | ○ | | |
| 11 | ● | ○ | Train runs backward suddenly, stop sharp and restarts. | 13.554 |
| | ● | ● | | |
| 12 | ● | ● | Train sounds horn while running. | 5.667 |
| | ● | ● | | |
| 13 | ○ | ○ | Train runs normally. | 1.360 |
| | ○ | ○ | | |
| 14 | ○ | ○ | Train starts running. | 5.341 |
| | ○ | ○ | | |

○ = not activated by sensor
● = activated, namely closed, by sensor

In positions 13 and 14 the switches A and B are not operated. The 12 different operations of the train are set out for items 1 to 12. As indicated, there is a chip 100 which receives different input signals from switches along lines 101, 102 and 103. These switches correspond to the appropriate operation of the contacts 35 of the leaf springs (28 or 29) or switch 31. The main switch 60 is operated to set the system in motion and further operation of switch 31 closes the circuit. The light-emitting diode 30 is connected to the chip 100, and the inappropriate operation of the chip 100 will cause the LED 30 to flash or emit light as required. The chip 100 also operates a motor control unit 104 for operating the motor 26. A further output 105 from the chip is directed to an amplifier 106 for operating the speaker 25 in the train.

Exemplary Scenarios

1. The train stops at the station to let a passenger get on the train, then departs. A sensor is placed near the train station.
2. The train stops. The Start/Stop button is pressed to restart.
3. The train runs over a dragon's back. The sensor is placed near the tail of the dragon for better effect.
4. The train speeds up for a while, then goes back to normal speed.
5. The train runs across the road junction.
6. The train stops to let a cow cross the rail, then restarts again.
7. The train plays the song "Oh! Susanna" and runs at high speed.
8. The train runs into a thunderstorm.
9. The train crosses a wooden bridge.
10. The train is sucked into a whale's mouth, but finally escapes. The sensor is placed near the mouth of the whale.
11. The train suddenly runs backward, stop sharply, and then restarts.
12. The train sounds the horn while running.

Figure 13:
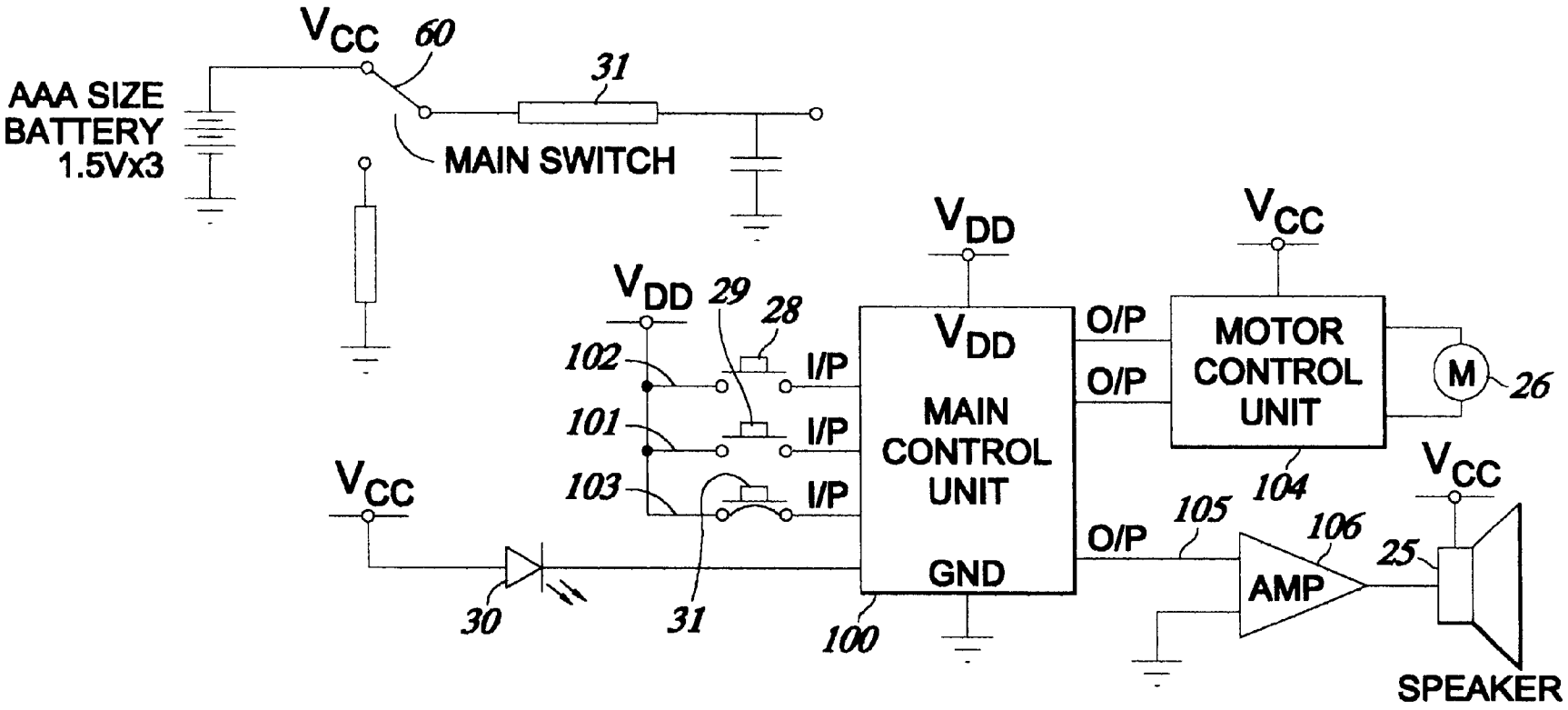
FIG. 13 is a circuit diagram of the control system for operating the locomotive in terms of the invention.

The circuit board 24 of the control system is set out in FIG. 13.

In FIGS. 9A, 9B, 9C, 11A, 11B and 11C there are different scenarios of track laid out. In FIG. 9A there is shown a situation where the tracks 20 and 21 are combined together to form different close circuit loops, and where they ascend and descend irregularly and pass over each other. The different combination of pillars 150, 151, 153 and 154 are used to effect this relationship. FIG. 9B the undulations are much more gentle and only pillar 152 would be used in that simple configuration. In FIG. 9C there is a figure eight configuration, and again pillars 152 are used in that format.

Figure 11A:
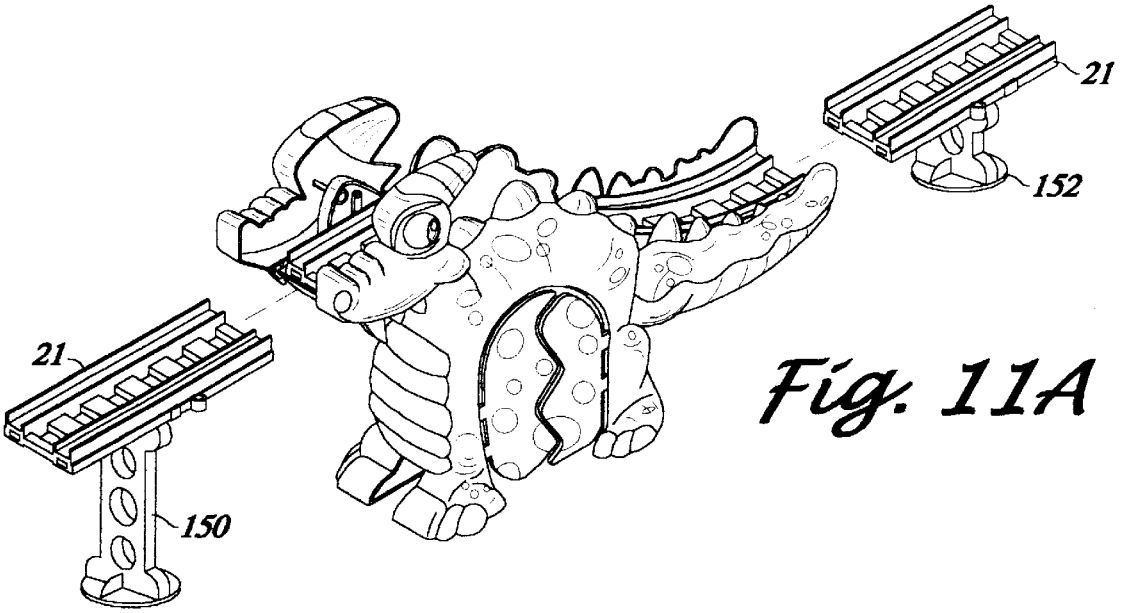
FIGS. 11A–11C are different configurations and animations which can be added in and about the track to enhance the interactive operation and enjoyment of a toy train.
Figure 11B:
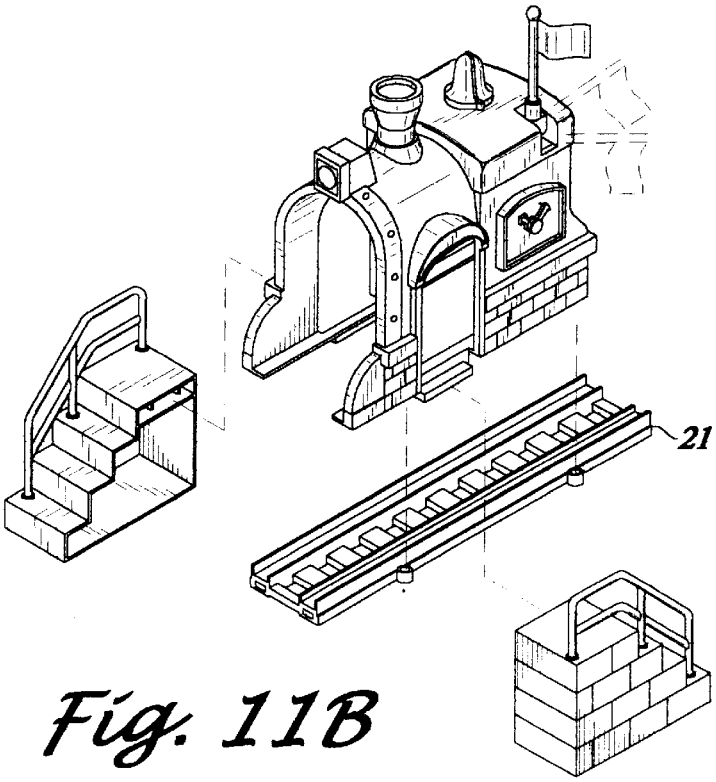
Figure 11C:
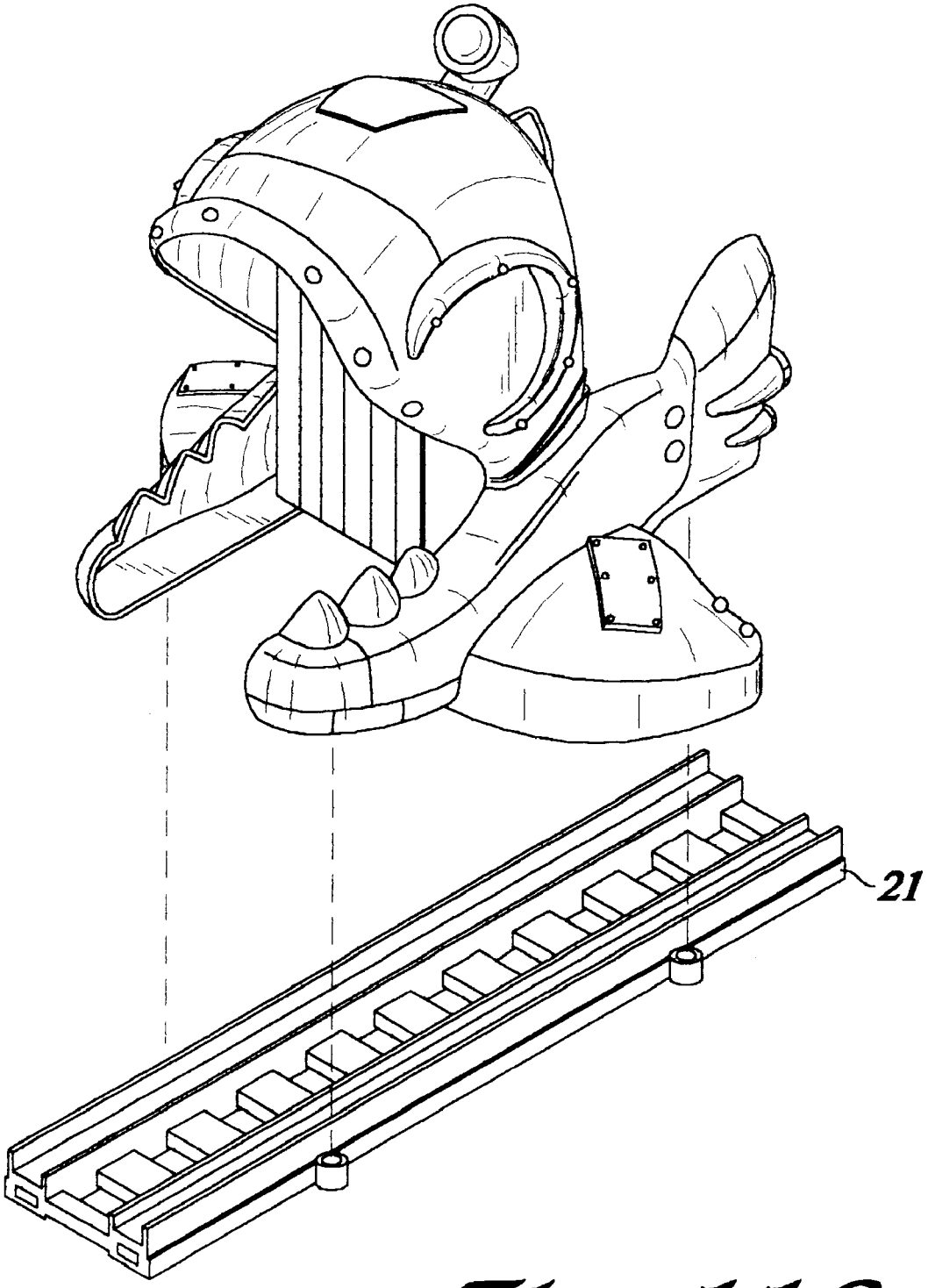

In FIGS. 11A, 11B and 11C there are different configuration through which the tracks 21 pass. In FIG. 11A there is a dragon configuration which has a track built into the back of the dragon. The track connects with the portions 20 which are on columns 152.

In FIG. 11B the track 21 passes through a station-type house with a building configuration on either side. In FIG. 11C the track 21 passes through a different animated configuration.

Many other examples of the invention exist, each differing from the other in matters of detail only. For instance, instead of 4 triggers 36 on a sensor 22 under the locomotive 23, there could be more or less triggers. Further the sensors could be arranged in a different position relative to the track 20 and 21 and the locomotive 23. For instance, the sensors and switches could be on the side of the locomotive, and the track could mount the sensors in an appropriate position on the side of the track.

The invention is to be determined by the following claims.

What is claimed is:

1. A toy comprising:

a track defining a closed circuit, the track including component lengths which are separable and connectable to form a user-selected close circuit;

different multiple-trigger devices, the trigger devices being separable from the track and having connector means for permitting the trigger devices to be secured in selected locations with the track, the locations being selected by a user;

a vehicle for traveling on the track, the vehicle having motor means for turning wheels of the vehicle on the track, and including a power supply for the motor means;

a switch with the vehicle, such that the switch is operable by the different trigger devices as the vehicle moves along the track; and an electronically programmed chip within the vehicle for responding to signals from the switch for signaling the chip to control wheel rotation.

2. A toy comprising:

a track defining a closed circuit, the track including component lengths which are separable and connectable to form a user-selected close circuit;

different multiple-trigger devices, the trigger devices being separable from the track and having connector means for permitting the trigger devices to be secured in selected locations with the track, the locations being selected by a user;

a vehicle for traveling on the track, the vehicle having motor means for turning wheels of the vehicle on the track, and including a power supply for the motor means;

a switch with the vehicle, such that the switch is operable by the different trigger devices as the vehicle moves along the track;

an electronically programmed chip within the vehicle for responding to signals from the switch for signaling the chip to control wheel rotation;

a light-emitting device and a speaker, and wherein the chip is operable to selectively actuate at least one of the light-emitting device and the speaker;

each said trigger device including multiple activating members, and wherein there are at least two switches in the vehicle, and wherein passage of the vehicle over one of said trigger devices effects activation of the at least two switches at least once.

3. A toy as claimed in claim 2 wherein each said trigger device activates one of said switches multiple times during the passage of the vehicle over the trigger device.

4. A toy as claimed in claim 2 wherein the track components include straight length portions of different lengths, curve length portions, of different lengths, and portions having gradients of different degrees.

5. A toy as claimed in claim 2 wherein the surface of the tracks includes spaced ridges, and wherein the wheels of the vehicle include grooves for engaging the ridges thereby to facilitate and control movement of the vehicle over the track.

6. A toy as claimed in claim 2 wherein the movement of the vehicle includes selectively different forward speeds, different reverse speeds, and a combination of forward and reverse motions.

7. A toy as claimed in claim 3 wherein sounds of the speaker actuated by said chip include at least one of the sounds of a train moving on a track, a bell, a whistle, creaking bridge sounds, and farmyard sounds.

8. A toy as claimed in claim 2 wherein the track portions include ornamental features connected with selected track portions.

9. A toy as claimed in claim 2 wherein each said switch includes a movable element mounted on an undercarriage of the vehicle, the switch being movable for engagement with at least one of said activating members of the trigger devices, and the switch including a leaf spring in the body of the vehicle.

10. A toy as claimed in claim 2 wherein said at least two switches are spaced transversely across the width of the vehicle, and wherein there are at least two activating means in the trigger device spaced transversely across the width of the track.

11. A toy as claimed in claim 1 including an on/off switch on the vehicle for activating and deactivating the vehicle, and wherein the on/off switch is selectively located in a chimney of the vehicle.

12. A toy as claimed in claim 2 wherein each said trigger device includes elements longitudinally directed and transversely directed relative to the direction of the track portion.

13. A toy as claimed in claim 2 wherein the track includes columns and a cradle for facilitating the secure positioning of the track at different gradients and heights.

14. A toy as claimed in claim 2 wherein the chip is programmed to operate the train on at least two different levels, a first simpler level and a second more complex level.

15. A toy train set comprising:

a track defining a closed circuit, the track including component lengths which are separable and connectable to form a user-selected close circuit;

different multiple-trigger devices, the trigger devices being separable from the track and having connector means for permitting the trigger devices to be secured in selected locations with the track, the locations being selected by a user;

a locomotive for traveling on the track, the locomotive having motor means for turning wheels of the locomotive on the track, and including a power supply for the motor means;

a switch with the locomotive, such that the switch is operable by the different trigger devices as the locomotive moves along the track;

an electronically programmed chip within the locomotive for responding to signals from the switch for signaling the chip to control wheel rotation; and the switch including a movable element mounted on an undercarriage of the locomotive, the switch being movable for engagement with activating members of the trigger devices.

16. A toy train set comprising:

a track defining a closed circuit, the track including component lengths which are separable and connectable to form a user-selected close circuit;

different multiple-trigger devices, the trigger devices being separable from the track and having connector means for permitting the trigger devices to be secured in selected locations with the track, the locations being selected by a user;

a locomotive for traveling on the track, the locomotive having motor means for turning wheels of the locomotive on the track, and including a power supply for the motor means;

a switch with the locomotive, such that the switch is operable by the different trigger devices as the locomotive moves along the track; and an electronically programmed chip within the locomotive for responding to signals from the switch for signaling the chip to control wheel rotation;

a light-emitting device and a speaker, and wherein the chip is operable to selectively actuate at least one of the light-emitting device and the speaker; and the track components include straight length portions of different lengths, curve length portions of different lengths, and portions having gradients of different degrees, and wherein the surface of the tracks includes spaced ridges, and wherein the wheels of the locomotive include grooves for engaging the ridges thereby to facilitate and control movement of the locomotive over the track.

17. A train as claimed in claim 16 wherein each said trigger device include multiple activating members, and wherein there are at least two switches in the locomotive, and wherein passage of the locomotive over the trigger device effects activation of the at least two switches at least once.

18. A locomotive as claimed in claim 16 wherein each said trigger device activates one of said switches multiple times during the passage of the locomotive over the trigger device.

19. A train set as claimed in claim 16 wherein the movement of the locomotive includes selectively different forward speeds, different reverse speeds, and a combination of forward and reverse motions.

20. A train set as claimed in claim 15 wherein the switch includes a leaf spring in the body of the locomotive.

21. A train set as claimed in claim 15 including at least two switches spaced transversely across the width of the locomotive, and wherein there are at least two activating means in the trigger device spaced transversely across the width of the track.

22. A train set as claimed in claim 15 wherein the activating members of each said trigger device include elements longitudinally directed and transversely directed relative to the direction of the track portion.

* * * * *